US008197022B2

(12) United States Patent
Saettel

(10) Patent No.: US 8,197,022 B2
(45) Date of Patent: Jun. 12, 2012

(54) AUTOMATED TIME OF FLIGHT SPEED COMPENSATION

(75) Inventor: John J. Saettel, Trotwood, OH (US)

(73) Assignee: Eastman Kodak Company, Rochester, NY (US)

( * ) Notice: Subject to any disclaimer, the term of this patent is extended or adjusted under 35 U.S.C. 154(b) by 345 days.

(21) Appl. No.: 12/568,733

(22) Filed: Sep. 29, 2009

(65) Prior Publication Data

US 2011/0074854 A1 Mar. 31, 2011

(51) Int. Cl.
*B41J 29/38* (2006.01)

(52) U.S. Cl. ..... 347/16

(58) Field of Classification Search ..... 347/9, 16, 347/37, 104

See application file for complete search history.

(56) References Cited

U.S. PATENT DOCUMENTS

| | | | | |
|---|---|---|---|---|
| 5,288,157 | A | 2/1994 | Tanaka | |
| 5,448,269 | A | 9/1995 | Beauchamp et al. | |
| 6,361,137 | B1 | 3/2002 | Eaton et al. | |
| 6,910,752 | B2 * | 6/2005 | Shoji | 347/14 |
| 2004/0095478 | A1 * | 5/2004 | Takano et al. | 348/223.1 |
| 2005/0195229 | A1 | 9/2005 | Barss | |

FOREIGN PATENT DOCUMENTS

| | | |
|---|---|---|
| EP | 0 121 304 | 10/1984 |
| EP | 1 287 992 | 1/2009 |

OTHER PUBLICATIONS

J. J. Saettel et al., "A Calibration System for Multi-Printhead Ink Systems", U.S. Appl. No. 12/568,713, filed Sep. 29, 2009.
J. J. Saettel et al., "Color to Color Registration Target", U.S. Appl. No. 12/568,750, filed Sep. 29, 2009.
J. J. Saettel et al., "Exposure Averaging", U.S. Appl. No. 12/568,762, filed Sep. 29, 2009.

* cited by examiner

*Primary Examiner* — An Do
(74) *Attorney, Agent, or Firm* — Peyton C. Watkins

(57) ABSTRACT

A method for determining a speed compensation factor includes the steps of transporting a media moving at first speed; printing a first image on the media using at least one printhead while moving at the first speed; capturing the first image in a first frame of an image capture device; transporting the media moving at a second speed different from the first speed; printing a second image on the media using the at least one printhead while moving at the second speed; capturing the second image in a second frame of the image capture device; determining using a change of position of the first image relative to the second image using automated image analysis; and inputting the determined change of position into a processor for computing the speed compensation factor from the determined change of position and a known difference in speed between the first and second speeds.

12 Claims, 2 Drawing Sheets

AUTOMATED TIME OF FLIGHT SPEED COMPENSATION

CROSS REFERENCE TO RELATED APPLICATIONS

Reference is made to commonly assigned U.S. patent application Ser. No. 12/568,762, filed Sep. 29, 2009 by John Saettel, entitled "Exposure Averaging", commonly assigned U.S. patent application Ser. No. 12/568,13 filed Sep. 29, 2009 by John Saettel, entitled "A Calibration System For Multi-Printhead Ink Systems", and commonly assigned U.S. patent application Ser. No. 12/568,750 filed Sep. 29, 2009 by John Saettel, entitled "Color to Color Registration Target" the disclosures of which are herein incorporated by reference.

FIELD OF THE INVENTION

The present invention generally relates to inkjet printing systems and, more particularly, to such inkjet systems that print and capture an image of a test registration target for determining speed compensation factor(s) due to speed variations of the media.

BACKGROUND OF THE INVENTION

High-speed, multi-color inkjet printing systems need calibration for a variety of reasons including the need to accurately position the printed image at the proper position on the print media. For example, it is a well know fact that changes in transport speed of the media will result in color-to-color (C2C) registration changes. The reason for these changes can be attributed to two factors. The main contributing factor is "Time of Flight" (TOF)—the time required for an ink droplet to exit the print head and impact the substrate. The second contributing factor can be changes in substrate tension, with changes in transport speed. These factors produce a nearly linear relationship between the speed of the transport and registration error. Current technology allows an operator to manually adjust the TOF/Speed Compensation variable. This variable is expressed in units of time and defines the C2C/Speed slope relationship. This variable is then used by the system to automatically advance each colors print head timing depending on the current speed of the transport.

Although the above-described method is satisfactory, improvements are always desired. One such improvement is to automate the implementation of the TOF/Speed Compensation variable.

SUMMARY OF THE INVENTION

The present invention is directed to overcoming one or more of the problems set forth above. Briefly summarized, according to one aspect of the invention, the invention resides in a method for determining a speed compensation factor in an inkjet printing system, the method comprising the steps of (a) transporting a media moving at first speed; (b) printing a first image on the media using at least one printhead while moving at the first speed; (c) capturing the first image in a first frame of an image capture device; (d) transporting the media moving at a second speed different from the first speed; (e) printing a second image on the media using the at least one printhead while moving at the second speed; (f) capturing the second image in a second frame of the image capture device; (g) determining using a change of position of the first image relative to the second image using automated image analysis; (h) inputting the determined change of position into a processor for computing the speed compensation factor from the determined change of position and a known difference in speed between the first and second speeds.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
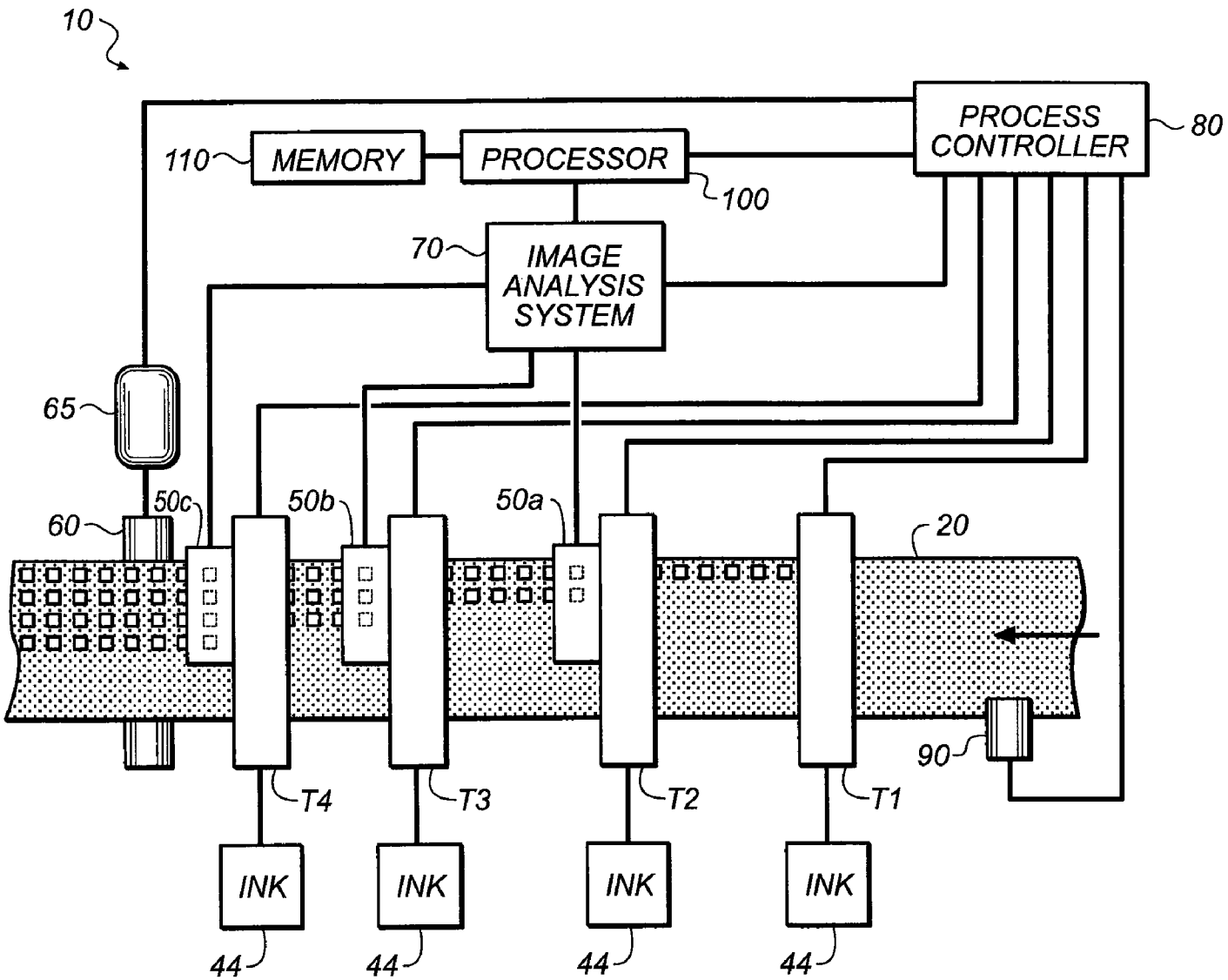
FIG. 1 is a block diagram of the calibration system of a multi-printhead printing system of the present invention.
Figure 2:
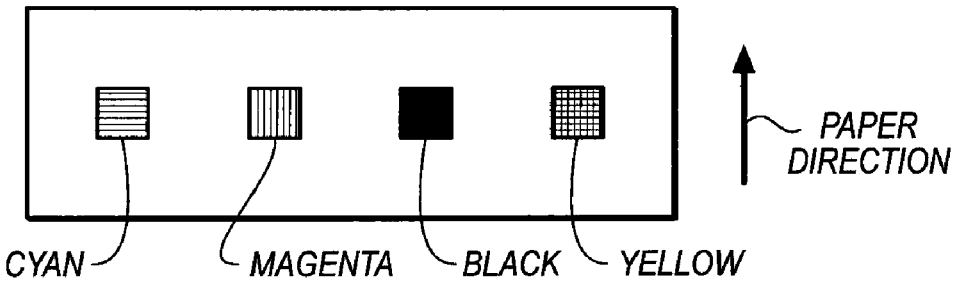
FIG. 2 is diagram of a typical test registration target of the present invention.

Turning now to FIG. 1, there is shown a block diagram of the printing system 10 of the present invention. The printing system 10 includes a transport for transporting the print media 20 through various stages of the printing process. Four printheads (T1, T2, T3 and T4) span over the print media 20 each for preferably dispensing ink of a different color on the print media 20 as the media 20 moves relative to the printheads T1-T4. In the preferred embodiment, each printhead T1-T4 prints a test mark so that, after printing by the last printhead T4, a 1×4 array of test marks are printed as shown in FIG. 2. Referring back to FIG. 1, four ink holding receptacles 44, each of a different color, are respectively attached to each printhead T1-T4 for supplying ink thereto. Three image capture devices 50*a*, 50*b* and 50*c* are respectively disposed immediately downstream and in close proximity of each of the last three printheads T2-T4, but not the first printhead T1. Each image capture device 50*a*, 50*b* and 50*c* includes a digital camera and a light source. Typically the light sources are strobe lights for producing a plurality of short bright flashes of light to allow an image to be captured without motion blur. Typically the strobe lights consist of a plurality of Light Emitting Diodes (LEDs), commonly of red, green and blue LEDs that are the color compliments of cyan, magenta, and yellow inks, respectively, that are printed by the printheads. By using LEDs that are the color complement of the color inks, image contrast is enhanced. For example, a yellow mark on the print media will appear as a high contrast dark mark when illuminated only with a blue LED. Black ink which absorbs all colors shows up in high contrast with any visible light LED so a separate LED is not needed for the black ink. Each image capture device 50*a*-50*c* captures an image of the media 20 after the printhead T2-T4 prints its respective ink on the media 20 for providing feedback as to the registration of the various color image plane and as to the accuracy of the TOF/Speed Compensation Variable used in the printing system. A drive motor 65 connected to a drive roller 60 exerts force on the print media for moving it through the printing system 10.

An encoder 90 is used to monitor the motion (in the direction of the arrow) of the print media 20 through the printing system 10. Typically the encoder 90 is in the form of a rotary encoder that creates a defined number of pulses per revolution. The rotary encoder is connected to a roller or wheel (not shown) that is rotated by the moving paper. The circumference of the wheel or roller, in combination with the defined number of pulses per revolution of the rotary encoder 90, determines the number of encoder pulses per centimeter or inch of paper travel. The output of the encoder 90, in the form of an encoder pulse train, is used by the process controller 80 for controlling the placement of the print media 20 along the direction of print media travel. Typically the spacing of pixels in the in-track direction (along the direction of paper motion) corresponds to N times the spacing between encoder pulses, where N is a small (<10) integer. To properly print a multicolor document, the print data sent to each printhead T2-T4 downstream of the first printhead T1 must be delayed by increasing amounts relative to the data of first printhead. These delays are normally defined in terms of a delay count or the number of the encoder pulses that correspond to the spacing along the paper path of the printheads T2-T4 from the first printhead T1. For example, if the second printhead T2 is located 8.5 inches downstream of the first printhead T1 and the encoder 90 produces 600 pulses per inch, the print data to the second printhead T2 would be delayed by 5100 pulses relative to the data to the first printhead T1.

The print media 20 passes under and in the optical path of the image capture devices 50*a*-50*c*, such as a digital camera, in order to capture the printed test marks from the printheads T1-T4. Various digital cameras can be employed provided they have sufficient optical resolution and light sensitivity to capture images of the test marks. One such useful camera is the IMP-VGA210-L from Imperx. This is a black and white camera with a 640×480 pixel resolution. It is able to output images at a rate of 210 complete frames per second through a CameraLink™ interface to an image processing system. This camera also has an external trigger and an externally controllable electronic shutter so that acquisition of images and the shutter time for acquiring an image can be controlled by the process controller 80. This camera also allows a portion of the active pixels in the captured image frame to be defined as an area of interest. The camera sensor then uses only that portion of its active pixels for image capture, and only transfers the image data corresponding to that area of interest to the image system analyzer 70. By so doing, the camera is able to capture and transfer partial frame images at higher frame rates than its complete frame rate. An infinite conjugate micro-video lens from Edmund Optics, #56776, with a 25 mm focal length and a 1:1 magnification is an effective lens for use with this camera. In one embodiment, the strobe lights are light emitting diodes, two LED's each of red, green and blue, arranged circular around the lens of the camera. Light emitting diodes from Luxeon, such as LXHL-PH09, LXHL-PM09, and LXHL-PRO09, are examples of usable LED's. The image capture device may be mounted on a carriage downstream of each printhead so that the image capture device is adjustable in position in a cross-track direction. Alternatively, the image capture device may be mounted directly to the downstream side of the printhead so that it can capture the image of the test marks printed by that printhead and the first printhead.

Just as the process controller 80 can use the output of the encoder 90 in combination delay count values associated with each printhead to register the print from the various printheads, the process controller can control the flashing of the strobe lights and the capturing of a frame by the camera to a particular portion of the printed image by using a delay count associated with the image capture device and the output of the encoder.

Figure 3:
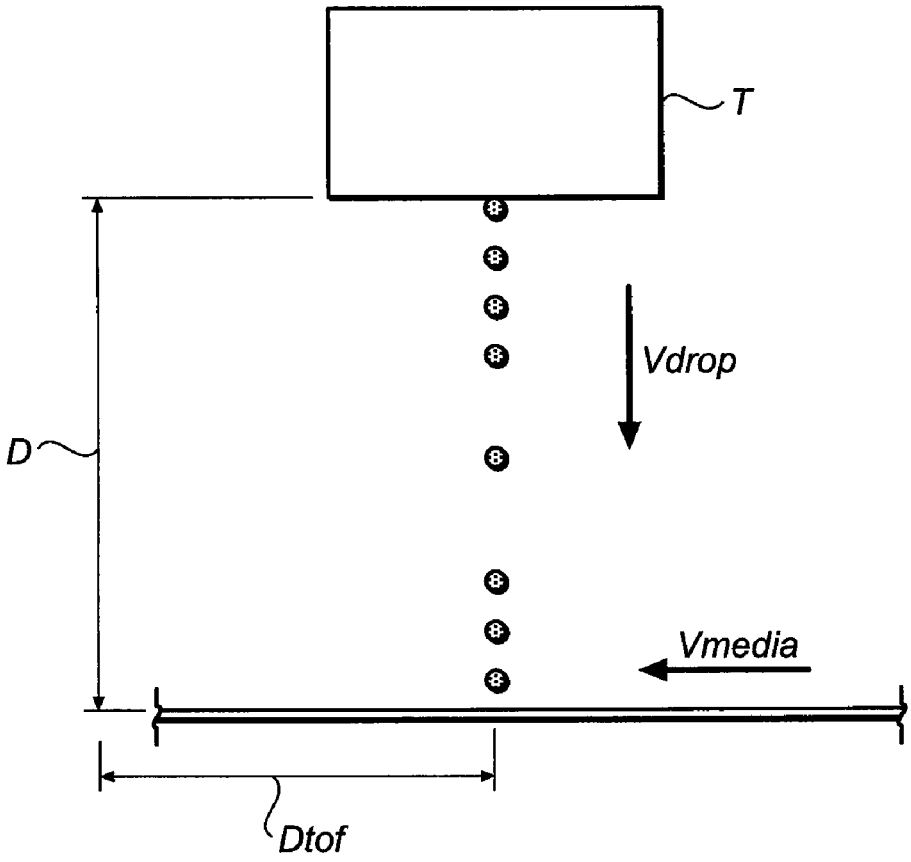
FIG. 3 is a diagram illustrating dropping of ink from a printhead.

FIG. 3 is a side view of an inkjet printhead T in a print position over a print media. When printing, the print media is moved relative to the printhead T at a velocity $V_{media}$. Print drops are created by the printhead T with a velocity $V_{drop}$. These print drops must travel a distance D before striking the print media. The transit time $T_{tr}$ for the drops to travel the distance D is $$T_{tr} = \frac{D}{V_{drop}}$$

The print media, which is moving at a velocity $V_{media}$, moves a time of flight displacement distance $D_{tof}$ during this drop transit time; given by $$D_{tof} = V_{media} * T_{tr}$$

To ensure proper placement of an inkjet printed image on the print media, requires accounting for this time of flight displacement distance $D_{tof}$. To hit the desired target location on the moving print media, it is necessary for the print drop to be fired or created when the target location on the print media has a distance of $D_{tof}$ to travel to reach the drop impact position. In high speed inkjet printing systems that account for the time of flight displacement distance, typically the velocity of the print media is not a constant value established during product development, but rather is adjustable up to some upper speed limit. Therefore it is necessary to calculate the distance $D_{tof}$ based on the print media speed $V_{media}$ rather than use a fixed value for $D_{tof}$. As nominal values for the distance D and for the drop velocity $V_{drop}$ are defined or determined during product development, a nominal value for the transit time can be calculated and used in combination with the measured print media velocity $V_{media}$ to calculate the distance Dtof. (The print media velocity is typically determined from the frequency of pulses from the encoder 90.) While nominal values of the D and drop velocity $V_{drop}$, can be used in the calculation of $T_{tr}$ and $D_{tof}$, the actual values for D and $V_{drop}$ can differ from the nominal value. For example, differences in the printhead mount and print media guide rollers can cause the actual value of D to differ from the nominal value. Similarly variations in nozzle diameter, ink pressure, ink properties such as viscosity, and in the amplitude of drop creation pulses can all cause the drop velocity to differ from the nominal value. This can cause the printed image to be misaligned relative to some pre-printed image on the print media or it can cause the different image planes printed by different printheads to be misregistered.

The printing system 10 of the present invention includes various components that permit more accurate TOF/Speed Compensation factors to be determined and implemented in the printing system. In this regard, the printing system prints two separate images. The images can include test patterns such as is shown in FIG. 2. The first image is printed by a printhead with the print media moving relative to the printhead at a first speed. An image capture device is used to capture the first image in a first frame. Image capture device 50*c*, which is downstream of all the printheads, is a preferred image capture device as it can be used to capture images printed by any of the printheads. The speed of the print media through the printing system is changed, by means of the drive roller 60 driven by motor 65 under the control of the process controller 80. A second image is printed by the same printhead as the first image at a second speed that is different from the first speed. The same image capture device is used to capture a second frame that includes the second image.

In the printing of both the first and second images, the process controller calculates and employs the values for $D_{tof}$ for the appropriate print media velocities to serve as compensation distances to try to place the printed images at the target position on the print media. If the proper value for the drop transit time is used in calculating the Dtof values at the first and second media speed, the images printed at the first and second media speeds will print at their target locations. The use of a nominal transit time that differs from the actual transit time will result in the computed compensation distance being different from the actual time of flight displacement distance, resulting in the test marks missing their intended locations. Furthermore the amount by which the test marks miss the target location will depend on the difference in the media speed between the first and second media speed. This result can be understood, by means of the following analysis. As mentioned above.

$$D_{tof}=V_{media}*T_{tr}$$

If the media speed is equal to V1, the actual time of flight displacement distance $D1_{tof}$ is given by $$D1_{tof}=V_1*T_{tr}$$

If however a nominal value for the transit time, $T_{nom}$ is used instead of the actual transit time $T_{tr}$, the compensation distance $D_1$ used by the control to try to place the test mark at the target location with a media speed of $V_1$ would be.

$$D_1=V_1*T_{nom}$$

This compensation distance D1 differs from the actual time of flight displacement distance $D1_{tof}$ by an amount $\Delta D_1$ given by $$\Delta D_1=V_1*T_{nom}-V_1*T_{tr}=V_1*(T_{nom}-T_{tr})$$

One can also calculate for the second media speed $V_2$, values for the actual time of flight displacement distance $D2_{tof}$, compensation distance $D_2$ and the deviation of the test mark from the intended location $\Delta D_2$, as follows.

$$D2_{tof}=V_2*T_{tr}$$

$$D_2=V_2*T_{nom}$$

$$\Delta D_2=V_2*T_{nom}-V_2*T_{tr}=V_2*(T_{nom}-T_{tr})$$

It is clear that we could calculate the difference between the actual transit time and the nominal value at either media speed from a measurement of the test mark deviation distance $\Delta D$. This, however, is not practical as there is no mark on the print media to show the location of the intended location for the test marks to allow such measurements to be made.

It must be noted that at each media speed, an image capture device 50, under the control of the process controller 80, captures in a frame an image of the target location. The process controller 80 doesn't employ the calculated values of $D_{tof}$ for controlling the image capture devices as the capturing of an image by the image capture device is essentially instantaneous; image capture doesn't involve the drop transit time. Since an image capture doesn't involve a time of flight displacement distance, the target location for the test marks remains fixed, within the captured image frame independent of the media speed. While the location within the captured frame of the target location is not know, the fact that the target location remains fixed independent of media speed allows one to determine the deviation of the nominal transit time from the actual value. This is done by means of a measurement of the shift in the test mark location with the frames captured at media speed 1 and media speed 2, δD.

$$\delta D=\Delta D_1-\Delta D_2=(V_1-V_2)*(T_{nom}-T_{tr})$$

From this we get $$T_{nom}-T_{tr}=\frac{\delta D}{(V_1-V_2)}$$

This allows the actual transit time to be determined $$T_{tr}=T_{nom}+\frac{\delta D}{(V_1-V_2)}$$

To improve the correction amount for the transit time, preferably, one of the first and second speeds is near the maximum speed of the media and the other speed is near the slowest speed at which the media moves smoothly through the printing system without significant velocity variation. This provides the largest velocity difference and the largest shift in test mark location δD. The transit time calculated in this manner can then be used as the new value for the $T_{nom}$ used to calculate the compensation distances for printing at any media speed. This value may be stored in memory 110 for use by the printing system 10.

This analysis has shown that the actual drop transit time can be calculated from the measured shift in the test mark location and the two media speeds. From an implementation point of view, it must be recognized that each of the measurements may involve some scaling factors. For example the velocity may be determined from a measurement of the encoder pulse frequencies with a scaling factor to convert from frequency to a linear speed. Similarly the shift distance dD can be measured from a measurement of the shift measured in the pixels in the frame with a scaling factor from pixels to actual distance. As a result of these various scaling factors being used, it may be more convenient to calculate a compensation factor or term that deviates from the actual transit time by some scaling factor. Such a compensation factor can then be employed to determine appropriate compensation for the drop time of flight at any media speed.

As the actual transit time can drift as a result of drifting operation parameters and ink properties, it is appropriate to repeat this test after a period of time. As a result, a second speed compensation factor may also be computed that is compared to the original compensation factor for detecting a change in a variable of the inkjet printing system other than the speed compensation factor. The tracking of compensation factors determined in this manner may then be utilized by the process controller as part of its internal diagnostics.

Camera 50*c* captures each image when all four colors are desired in the captured image. However, the present invention is not limited to this design. Any of the cameras 50*a*-50*c* may be used to capture the two images printed at the first and second media speeds. Any camera that can capture the test marks printed by a particular printhead can be used to capture the two images printed at the first and second media speeds from which a TOF/speed compensation variable can be determined for that printhead. After image capture, the image system analyzer 70 converts the images into bit maps, identifies each of the test marks, and determines their locations within the image.

Although the analysis is preferably done in the image system analyzer 70, a separate processor 100 may also be used. The processor 100 receives input from each of the cameras 50*a*-50*c*, as does the image system analyzer 70, although the input lines are omitted from FIG. 1 for clarity.

It is also noted that, while the description above describes the printer in terms of four printheads each printing a separate color, the invention is not limited to printing systems having exactly four printheads.

PARTS LIST

10 printing system
20 media
44 ink
50*a* camera
50*b* camera
50*c* camera
60 drive roller
65 drive motor
70 image analysis system
80 process controller
90 encoder
100 processor
110 memory

The invention claimed is:

1. A method for determining a speed compensation factor $T_{tr}$ to be used along with a measurement of media velocity for determining a time of flight displacement distance in an inkjet printing system, the method comprising the steps of:

(a) transporting a media moving at first speed $V_1$;

(b) printing a first image on the media using at least one printhead while the print media is moving at the first speed relative to the at least one printhead;

(c) capturing the first image in a first frame of an image capture device;

(d) transporting the media moving at a second speed $V_1$ different from the first speed;

(e) printing a second image on the media using the at least one printhead while moving at the second speed;

(f) capturing the second image in a second frame of the image capture device;

(g) determining a change of position of the first image relative to the second image using automated image analysis $\delta D$ ;

(h) inputting the determined change of position into a processor for computing the speed compensation factor $T_{tr}$ from the determined change of position and a known difference in speed between the first and second speeds.

2. The method as in claim 1, wherein either the first or second speed is the maximum speed of the inkjet printing system.

3. The method as in claim 1 further comprising the step of using four printheads in steps (b) and (e).

4. The method as in claim 3 further comprising the step of determining the speed compensation factor for each printhead.

5. The method as in claim 1, wherein the automated image analysis is performed in the processor or via a separate processor.

6. The method as in claim 1 further comprising providing an encoder for measuring displacement or motion of the media through the inkjet printing system.

7. The method as in claim 6, wherein the timing of the frames captured by the image capture device is dependent on output from the encoder.

8. The method as in claim 1, wherein the first and second speeds are measured using the output of the encoder.

9. The method as in claim 1 further comprising using a camera and a strobe as the image capture device.

10. The method as in claim 1, wherein the computed speed compensation factor is stored in electronic memory.

11. The method as in claim 10 further comprising the step of computing a second speed compensation factor that is compared to the original compensation factor for detecting a change in a variable of the inkjet printing system other than the speed compensation factor.

12. The method as in claim 1, wherein the step of computing the speed compensation factor comprises computing a speed compensation factor for a plurality of jets in the printhead.

* * * * *